US008207460B2

(12) United States Patent
Rodriguez et al.

(10) Patent No.: US 8,207,460 B2
(45) Date of Patent: Jun. 26, 2012

(54) ELECTROSTATICALLY ACTUATED NON-LATCHING AND LATCHING RF-MEMS SWITCH

(75) Inventors: Lorenzo G. Rodriguez, El Paso, TX (US); James Henry Campbell, El Paso, TX (US); Jose G. Mireles, Chihuahua (MX)

(73) Assignee: Senda Micro Technologies, Inc., El Paso, TX (US)

( * ) Notice: Subject to any disclaimer, the term of this patent is extended or adjusted under 35 U.S.C. 154(b) by 164 days.

(21) Appl. No.: 12/688,043

(22) Filed: Jan. 15, 2010

(65) Prior Publication Data

US 2010/0181173 A1 Jul. 22, 2010

Related U.S. Application Data

(60) Provisional application No. 61/145,668, filed on Jan. 19, 2009.

(51) Int. Cl.
*H01H 57/00* (2006.01)
*H01H 51/22* (2006.01)

(52) U.S. Cl. ..... 200/181; 335/4; 335/78; 335/80; 335/83; 335/86

(58) Field of Classification Search ..... 335/4, 78–86; 200/181
See application file for complete search history.

(56) References Cited

U.S. PATENT DOCUMENTS

| | | | | |
|---|---|---|---|---|
| 2,467,720 | A * | 4/1949 | Bascum | 335/18 |
| 2,919,324 | A * | 12/1959 | Schuessler | 335/137 |
| 6,144,545 | A * | 11/2000 | Lee et al. | 361/233 |
| 6,506,989 | B2 * | 1/2003 | Wang | 200/181 |
| 6,686,639 | B1 * | 2/2004 | Tsai | 257/415 |
| 6,798,315 | B2 * | 9/2004 | Schaefer | 333/105 |
| 6,865,313 | B2 * | 3/2005 | Mao et al. | 385/18 |
| 6,975,193 | B2 * | 12/2005 | Knieser et al. | 335/78 |
| 7,046,411 | B1 * | 5/2006 | Fleming | 359/224.1 |
| 7,304,556 | B2 * | 12/2007 | Tamura et al. | 335/78 |
| 7,619,497 | B2 * | 11/2009 | Yuba et al. | 335/78 |
| 7,893,799 | B1 * | 2/2011 | Slicker et al. | 335/78 |

* cited by examiner

*Primary Examiner* — Mohamad Musleh
(74) *Attorney, Agent, or Firm* — Melissa A. Asfahani; Kermit D. Lopez; Luis M. Ortiz

(57) ABSTRACT

An RF MEMS switch apparatus includes a planar substrate and an electrostatic actuator formed thereon. The electrostatic actuator includes two sets of interdigitated comb which is capable of moving an armature and a shunt contact head. The armature can be connected to the substrate through a main return spring and one or more contact head support springs. The shunt contact head includes a primary shunt contact and one or more spring-loaded sacrificial contacts. The shunt contact head can serve as a primary contact to bridge a stationary input electrode and an output electrode. The switch is off in a relaxed position and when actuated the primary shunt contact comes into direct mechanical contact with the stationary input electrode and the stationary output electrode. The switch remains closed as long as the actuator is powered and the springs return the armature to the relaxed position when the power is removed.

15 Claims, 3 Drawing Sheets

ELECTROSTATICALLY ACTUATED NON-LATCHING AND LATCHING RF-MEMS SWITCH

CROSS-REFERENCE TO PROVISIONAL PATENT APPLICATION

This patent application claims the benefit under 35 U.S.C. §119(e) of U.S. Provisional Application Ser. No. 61/145,668 entitled: "Electrostatically Actuated Non-Latching and Latching RF-MEMS Switch," filed on Jan. 19, 2009 and is incorporated herein by reference in its entirety.

TECHNICAL FIELD

Embodiments are generally related to MEMS (Microelectromechanical Systems) devices and methods thereof. Embodiments are also related to MEMS-based switches. Embodiments are additionally related to electrostatically actuated switches.

BACKGROUND OF THE INVENTION

MEMS (Microelectromechanical Systems) include mechanical and electrical components having dimensions in the order of microns or smaller. MEMS structures can be employed in numerous applications including switches, actuators, valves and sensors. Microelectromechanical switches for radio frequency (RF) applications have been recognized as an enabling technology because the signal via the switches remains linear over a much broader bandwidth than similarly targeted solid state devices.

Electrical switches make and break electrical connection, and involve a switching electrical contact system that must then be actuated in some way. Switches can often be described as, for example, bi-stable latching, non-latching, and so on, depending on whether the switch remain closed after actuation forces are removed (latching) or not (non-latching). When switches are not bi-stable, they can be classified as "normally-open" or "normally-closed."

Majority of prior art electrostatically actuated switch, for example, employs a cantilever arm to make or break a switch contact. The switch contact may be electrostatically pulled down by a "gate" electrode so that a metalized contact material on the end of the cantilever makes contact with a metalized contact pad, thereby closing the circuit. The switch may include multiple layers that can result in residual stresses within the cantilever arm. Such configuration can cause warping of members that can destroy functionality, large actuation voltages, and durability issues associated with stiction and hot-switching. Additionally, such cantilever type switches are not readily modified to a latching configuration.

Another prior art MEMS electrostatic switch involves the use of a metallic membrane to close the switch contact(s). The switch is generally open and the membrane is closed by a pulling force that may be generated through an electrostatic field created between the membrane and a "gate" electrode. Consequently, such prior art switch suffer from stiction, plastic deformation and residual stresses that reduce life and production yields.

Based on the foregoing it is believed that a need exists for an improved electrostatically actuated RF-MEMS switch that exhibits fast switching, low insertion loss, high bandwidth and low voltage actuation operation, as described in greater detail herein.

BRIEF SUMMARY

The following summary is provided to facilitate an understanding of some of the innovative features unique to the present invention and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for an improved MEMS device.

It is another aspect of the disclosed embodiments to provide for an improved electrostatically actuated non-latching and/or latching RF-MEMS switch apparatus.

It is a further aspect of the disclosed embodiments to provide for an improved method for fabricating the RF-MEMS switch apparatus.

The aforementioned aspects and other objectives and advantages can now be achieved as described herein. An RF MEMS switch apparatus is disclosed which includes a planar substrate (e.g., SOI) and an electrostatic actuator formed thereon. The electrostatic actuator includes two sets of interdigitated combs which are capable of moving an armature and a shunt contact head. The armature can be connected to the substrate through a main return spring and one or more contact head support springs. The shunt contact head includes a primary shunt contact and can further include one or more spring-loaded sacrificial contacts. The shunt contact head can serve as a primary contact to bridge a stationary input electrode and an output electrode. The switch is off in a relaxed position and when actuated the primary shunt contact comes into direct mechanical contact with the stationary input electrode and the stationary output electrode. The switch remains closed as long as the actuator is powered and the springs return the armature to the relaxed position when the power is removed.

The two sets of interdigitated combs may include a moving comb and a stationary comb. The moving comb can be mechanically connected to the armature and the stationary comb can be connected to the substrate. An electrically conductive film can be deposited on adjacent faces associated with the moving comb and the stationary comb in such a manner as to create an actuation force in a direction of closure when the faces of the actuator are electrically biased. An electrical voltage can be applied so that each pair of fingers associated with the combs move closer due to electrostatic attraction force.

The switch can be maintained in the on position by applying continuous power to the actuation electrode. Removal of power causes the switch to open, whereupon the main contacts separate from the stationary input and output electrodes, and are assisted by the spring force stored in the sacrificial contact and return springs. Any hot-switching transients or arcing can occur at the sacrificial contacts, thereby maintaining the integrity of the main electrode contacts. The main return spring then continues to pull the armature back to the neutral position until the switch is at rest in the open position. A latching version of the switch can be constructed utilizing a ratchet mechanism and spring loading of the main contacts.

The switch can be fabricated by selectively and vertically etching trenches in a device layer associated with the substrate (e.g., a silicon-on-insulator wafer) for the contacts and the actuator vertical metal walls. The trenches can then be filled with a conductive metal utilizing a metal deposition process. The electrically conducting features can be insulated from the underlying substrate by an insulating layer such as, for example, silicon nitride, silicon dioxide, etc. Such microelectromechanical radio-frequency switch manufactured in high yields can therefore exhibit fast switching, low insertion loss, high bandwidth, hot-switching capability, and low voltage actuation operation.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

The particular values and configurations discussed in these non-limiting examples can be varied and are cited merely to illustrate at least one embodiment and are not intended to limit the scope thereof.

Figure 1:
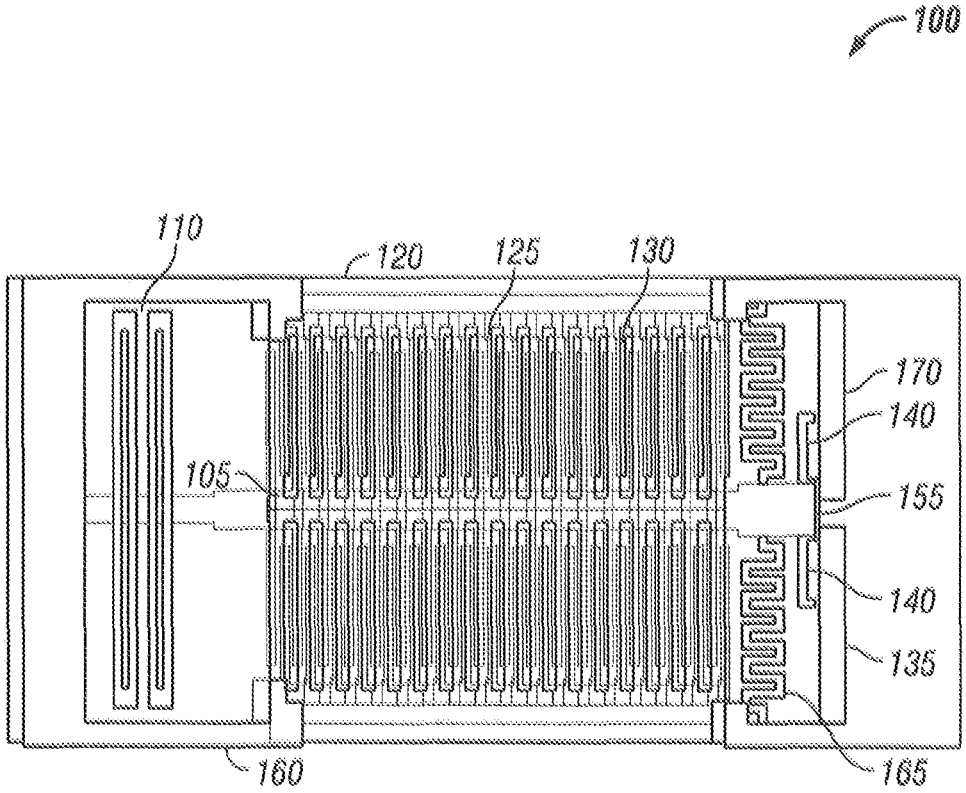
FIG. 1 illustrates a perspective view of an electrostatically actuated MEMS switch apparatus, in accordance with the disclosed embodiments.

FIG. 1 illustrates a perspective view of an electrostatically actuated MEMS switch apparatus 100, in accordance with the disclosed embodiments. The apparatus 100 generally includes an armature 105 connected to a substrate 160 via a main return spring 110 and one or more contact head support springs 165. The switch apparatus 100 can be fabricated on a device layer associated with the substrate 160 configured from a material such as, for example, silicon, depending upon design considerations. The apparatus 100 can be configured to include a contact head 155 associated with a primary shunt contact and one or more spring-loaded sacrificial contacts 140. The contact head 155 can be electrically conducting by means of metallization. The contact head 155 can be configured to provide a shunt between a stationary input electrode 170 and a stationary output electrode 135 upon making contact.

An electrostatic actuator 120 located on the substrate 160 is capable of moving the armature 105 and the shunt contact head 155. The spring-loaded sacrificial contacts 140 may be metalized with a refractory metal and the primary shunt contact can be metalized with gold or other suitable low resistance contact material, depending upon design considerations. It can be appreciated that other types of materials may be utilized in place of the suggested material. The electrostatic actuator 120 further includes two sets of interdigitated combs such as a stationary comb 125 and a moving comb 130. The moving comb 130 can be mechanically connected to the armature 105 and the stationary comb 125 can be connected to the substrate 160. Such electrostatic actuation mechanism can be referred to as a comb-drive; however other types of electrostatic actuation mechanisms can be configured for use with such an arrangement.

An electrically conductive film can be deposited on the comb 125 and 130 associated with contracting electrode gaps in such a manner as to create an actuation force in the direction of closure when the two faces of the electrostatic actuator 120 are electrically biased. Note that the comb 125 and 130 can be configured from a material such as, for example, silicon. The comb-drive faces associated with the combs 125 and 130 moves closer to one another in the manner of an adjustable parallel plate capacitor, such that the armature 105 moves in a direction perpendicular to the long axis of the comb fingers and parallel to the substrate 160. It can be appreciated that the electrostatic actuation can be implemented in a direction parallel to the long axis of the comb fingers, or other electrostatic actuation mechanisms, depending upon design consideration.

The main return spring 110 and the contact head support springs 165 can be designed to provide sufficient force to return the armature 105 to a neutral, normally-off position. The spring members 110 and 165 can be shaped as a rectangular spring member, serpentine spring member, sagittal spring member, depending upon design considerations. It can be appreciated, of course, that other shapes may be utilized to implement the spring members. The springs 110 and 165 can be configured from silicon, however oxide layers may be employed if stronger spring forces are desired.

The spring-loaded sacrificial contacts 140 can be designed to overcome any adhesion forces that develop at the contact interface, for example, by stiction. The spring-loaded sacrificial contacts 140 can be preferably designed to be electrically conductive and to make contact at the input and output stationary electrodes 170 and 135 and can be designed such that it makes contact prior to the primary electrode so that it can function as a sacrificial contact in hot-switching operations. The switch apparatus 100 can be electrostatically actuated from the normally-off position, and moves towards the input and output stationary electrodes 170 and 135 until the primary contact head 155 makes contact with the stationary input and output contacts 170 and 135. The actuation mechanism may be configured as an electrostatic lateral interdigitated comb-drive as described herein, however other suitable actuation mechanism may be utilized, depending upon design configurations.

Figure 2:
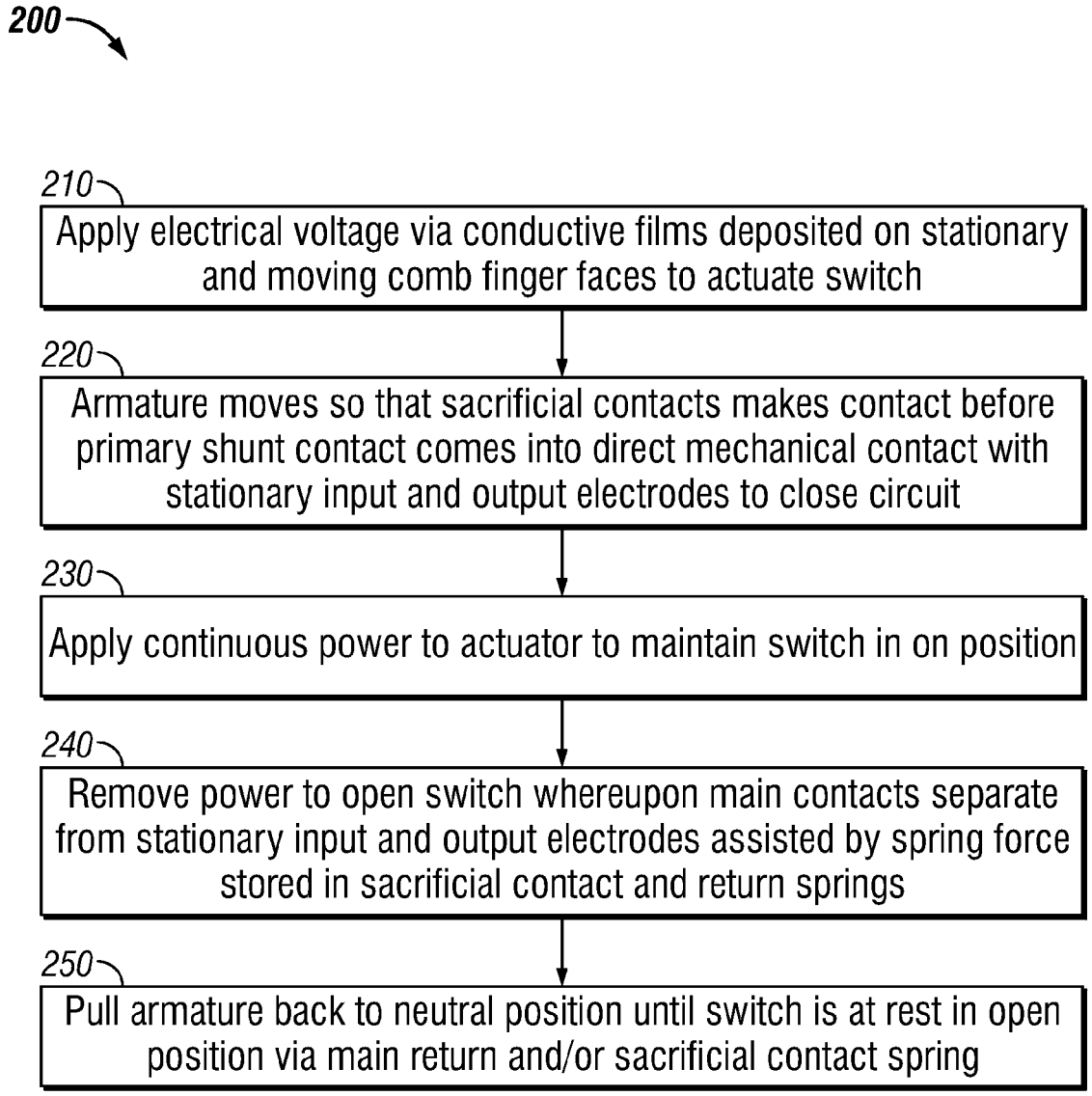
FIG. 2 illustrates a flow chart of operations illustrating logical operation steps of a method for operating the MEMS switch apparatus, in accordance with the disclosed embodiments.

FIG. 2 illustrates a flow chart of operations illustrating logical operation steps of a method 200 for operating the MEMS switch apparatus 100, in accordance with the disclosed embodiments. Note that in FIGS. 1-3, identical or similar blocks are generally indicated by identical reference numerals. An electrical voltage can be applied via the conductive films deposited only on the comb finger faces associated with contracting electrode gaps so that the comb 125 and 130 moves closer due to electrostatic attraction force, as depicted at block 210. The switch apparatus 100 can be actuated so that the primary shunt contact comes into direct mechanical contact with the stationary input electrode 170 and the stationary output electrode 135, as illustrated at block 220.

The switch apparatus 100 can be maintained in an "ON" position by applying continuous power to the electrostatic actuator 120, as indicated at block 230. The power can be removed in order to open the switch 100, whereupon the main contacts separate from the stationary input and output electrodes 170 and 135 assisted by the spring force stored in the spring-loaded sacrificial contact 140, as depicted at block 240. Any hot-switching transients or arcing occurs at the spring-loaded sacrificial contacts 140, thereby maintaining the integrity of the main electrode contacts.

The main return spring 110 then continues to pull the armature 105 back to the neutral position until the switch is at rest in the open position, as indicated at block 250. The spring constant over the range of armature 105 travel is governed by the return spring 110 and the spring-loaded sacrificial contacts 140. The resultant spring constant possess two slopes as a function of position in the preferred embodiment. It is apparent to those skilled in the art that multiple compound springs are possible, including a two-spring constant arrangement for the release spring by itself, for example, so that there are more than two effective spring constants over the range of armature travel.

The switching apparatus 100 in FIG. 1 depicts a non-latching version. A latching version may also be constructed in accordance with a preferred embodiment. The switch apparatus 100 may be latched into a closed position while maintaining sufficient contact loading force such that the contact resistance remains low. This can be achieved by utilizing a latching mechanism such as a ratchet mechanism, although other latching mechanisms may be conceived and employed, and by creating spring action in the main contacts by changing their configuration from that of a monolithic block, as depicted in FIG. 1, to one such that the contacts are spring-loaded.

The method of spring loading of the main contacts may be done by simply mounting the main contacts on thin beams such that the elastic bending of the beams supplies the spring loading. The sequence for latching involves the release of the latching mechanism, followed by actuation such that the main contacts are loaded as necessary to achieve the low resistance contact required, followed by engaging the latching mechanism in this loaded condition. The final step is the removal of power from the actuation mechanism, at which point the switch apparatus 100 is latched in the closed position and no power is being drawn by the switch apparatus 100.

Figure 3:
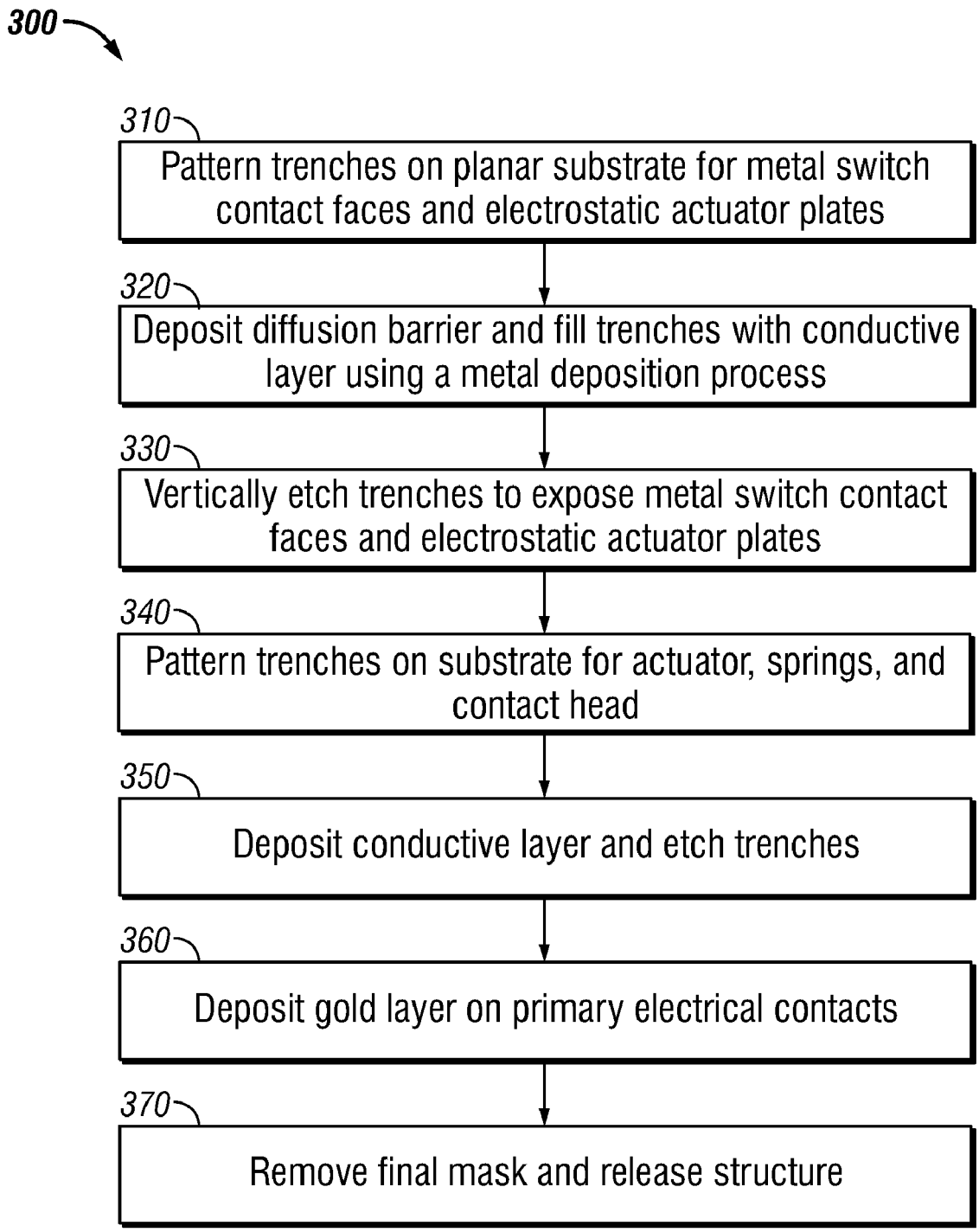
FIG. 3 illustrates a flow chart of operations illustrating logical operation steps of method for fabricating the MEMS switch apparatus, in accordance with the disclosed embodiments.

FIG. 3 illustrates a flow chart of operations illustrating logical operation steps of method 300 for fabricating the MEMS switch apparatus 100, in accordance with the disclosed embodiments. The MEMS switch apparatus 100 can be made in accordance with various known fabrication processes. The MEMS switch, however, can be constructed on a commercially available silicon-on-insulator (SOI) wafer. Such an SOI wafer can include a single-crystal base. Although the SOI wafer can be configured according to a standard wafer bonding process, it can be understood that such an SOI wafer is described herein for illustrative and exemplary purposes only, and can be configured according to other fabrication processes.

The trenches can be patterned on the substrate 160 for fabricating various metal walls, for example the signal contacts, contact bridge plates, and the electrostatic actuator face plates, as indicated at block 310. The switch 100 can be fabricated on a device layer associated with the substrate 160. The diffusion barrier can be deposited and the trenches can be filled with conductive layer using a metal deposition process, as indicated at block 320. The trenches can be etched vertically to expose metal switch contact faces and electrostatic actuator plates, as depicted at block 330. The device layer can be preferably etched utilizing standard silicon etching procedures, such as a DRIE (Deep Reactive Ion Etch) process. Preferably, a standard photolithography process can be utilized to define the desired structural shapes in the substrate 160. Various etching techniques can be employed to expose the metal-filled DRIE trenches, which upon exposure, become the actuator electrode metallization and the electrical contact base metal.

The trenches can then be patterned on the substrate 160 for the shunt contact head 155, primary shunt contact and electrostatic actuator 120, and springs 110 and 140, as illustrated at block 340. The conductive layer can be deposited and the trenches can be etched, as indicated at block 350. DRIE is the second deep trench etch process, which can be employed to expose the metal walls, but those skilled in the art will recognize that any deep trenching process can be utilized. The device layer becomes a planar substrate of silicon for the apparatus 100 that includes the electrostatic actuator 120, the main spring return 110, and switch contacts on the contact head 155 that is directly connected to the electrostatic actuator 120.

The electrically conducting features can be insulated from the underlying substrate by an insulating layer such as, for example, silicon nitride, silicon dioxide, etc. A gold layer can then be deposited on the primary electrical contacts, as illustrated at block 360. The final mask can be removed and the structure can be released by a hydrogen Fluoride (HF) etch or similar etch, as indicated at block 370. The microelectromechanical radio-frequency switch apparatus 100 described herein can be manufactured in high yields and that exhibits fast switching, low insertion loss, high bandwidth, hot-switching capability, and low voltage actuation operation.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A radio-frequency MEMS switch, comprising:

an armature connected to a planar substrate via a main return spring and a plurality of contact head support springs;

a shunt contact head that includes a primary shunt contact and a plurality of spring-loaded sacrificial contacts, wherein said shunt contact head serves as a primary contact to bridge a stationary input electrode and a stationary output electrode; and an actuator formed on said planar substrate capable of moving said armature and said shunt contact head, wherein said actuator is actuated so that said primary shunt contact comes into direct mechanical contact with said stationary input electrode and said stationary output electrode to close circuit as long as said actuator is powered.

2. The MEMS switch of claim 1 wherein said return spring and said plurality of contact head support springs maintain said armature in a normally OFF switch open position.

3. The MEMS switch of claim 1 wherein said return spring return said armature to a relaxed position if power is removed from said actuator.

4. The MEMS switch of claim 1 further comprising:

a moving comb associated with said actuator and mechanically connected to said armature; and a stationary comb associated with said actuator and connected to said substrate.

5. The MEMS switch of claim 4 wherein said moving comb and said stationary comb comprises an interdigitated electrode face topography.

6. The MEMS switch of claim 4 further comprising:

an electrically conductive film deposited on adjacent faces associated with said moving comb and said stationary comb in such a manner as to create an actuation force in a direction of closure when said faces of said actuator is electrically-biased.

7. The MEMS switch of claim 1 wherein said actuator is actuated based on an electrostatically actuated latching mechanism in a normally open position.

8. The MEMS switch of claim 1 wherein said actuator comprises at least one electrostatic actuation mechanism.

9. The MEMS switch of claim 1 wherein said return spring and said plurality of contact head support springs comprises a dual-slope spring constant operative in different regions of spring travel.

10. The MEMS switch of claim 1 wherein said return spring and said plurality of contact head support springs is configured to comprise at least one of the following types of spring members:

a rectangular spring member;

a serpentine spring member; or a sagittal spring member.

11. A radio-frequency MEMS switch, comprising:

an armature connected to a substrate via a main return spring and a plurality of contact head support spring, wherein said substrate comprises a silicon-on-insulator wafer;

a shunt contact head that includes a primary shunt contact and a plurality of spring-loaded sacrificial contacts, wherein said shunt contact head serves as a primary contact to bridge a stationary input electrode and a stationary output electrode; and an actuator formed on said substrate capable of moving said armature and said shunt contact head, wherein said actuator is actuated so that said primary shunt contact comes into direct mechanical contact with said stationary input electrode and said stationary output electrode to close circuit as long as said actuator is powered.

12. A radio-frequency MEMS switch, comprising:

an armature connected to a planar substrate via a main return spring and a plurality of contact head support springs;

a shunt contact head that includes a primary shunt contact and a plurality of spring-loaded sacrificial contacts, wherein said shunt contact head serves as a primary contact to bridge a stationary input electrode and a stationary output electrode;

an actuator formed on said planar substrate capable of moving said armature and said shunt contact head, wherein said actuator comprises at least one electrostatic actuation mechanism;

a moving comb associated with said actuator and mechanically connected to said armature; and a stationary comb associated with said actuator and connected to said substrate, wherein said actuator is actuated so that said primary shunt contact comes into direct mechanical contact with said stationary input electrode and said stationary output electrode to close circuit as long as said actuator is powered.

13. The MEMS switch of claim 12 wherein:

said return spring and said plurality of contact head support springs maintain said armature in a normally OFF switch open position; and said return spring return said armature to a relaxed position if power is removed from said actuator.

14. The MEMS switch of claim 12 wherein said moving comb and said stationary comb comprises an interdigitated electrode face topography.

15. The MEMS switch of claim 12 further comprising:

an electrically conductive film deposited on adjacent faces associated with said moving comb and said stationary comb in such a manner as to create an actuation force in a direction of closure when said faces of said actuator is electrically biased.

* * * * *